US005319810A

United States Patent [19]

Metzger

[11] Patent Number: 5,319,810

[45] Date of Patent: Jun. 14, 1994

[54] TOILET FLUSHING ARRANGEMENT

[76] Inventor: Romain Metzger, 15559 Brookridge Blvd., Brooksville, Fla. 34613

[21] Appl. No.: 63,544

[22] Filed: May 19, 1993

[51] Int. Cl.[5] ..... E03D 5/04

[52] U.S. Cl. ..... 4/408; 4/246.2

[58] Field of Search ..... 4/408, 249, 250, 246.2, 4/335, 405, 473, 486, 468

[56] References Cited

U.S. PATENT DOCUMENTS 5,058,216 10/1991 Trayer et al. ..... 4/246.2

5,177,818 1/1993 Tsai ..... 4/246.2

*Primary Examiner*—Ernest G. Cusick

*Assistant Examiner*—Gregory Vidovich

*Attorney, Agent, or Firm*—Richard W. Carpenter

[57] ABSTRACT

A toilet flushing arrangement designed to encourage keeping the toilet seat and cover in the closed position when the toilet is not in use. The arrangement includes a flexible line having an inner end connected to an internal flush valve and and outer end automatically detachably connectable to a toilet seat cover, when the cover is moved to a vertical open position, so that, when the cover and seat are moved toward a horizontal closed position, tension on the line will lift the flush valve causing the toilet to be flushed.

20 Claims, 1 Drawing Sheet

TOILET FLUSHING ARRANGEMENT

BACKGROUND OF THE INVENTION

1. Field of the Invention

This invention relates to toilet flushing arrangements, and more particularly to an arrangement for insuring that the seat and cover of a toilet must be moved toward a closed position in order for the toilet to be flushed.

2. Description of the Background Art

A background art search directed to the subject matter of this invention conducted in the U.S. Patent and Trademark Office disclosed the following U.S. Letters Patent:

| | | |
|---|---|---|
| 1,605,939 | 3,579,664 | 4,519,105 |
| 4,839,928 | 4,974,263 | 5,177,818 |

None of the patents uncovered in the search discloses an arrangement wherein the toilet flush mechanism is operated, only when the toilet seat and cover are moved downwardly toward a closed position, by means of an actuating device substantially all of which is concealed within the toilet water cabinet at all times except during the actual flushing operation.

SUMMARY OF THE INVENTION

It is a primary object of the invention to provide an improved toilet flushing arrangement that insures that the toilet seat and cover will normally remain in the closed position when the toilet is not in use.

Another object is the provision of an arrangement for flushing a toilet wherein the toilet flushing mechanism is actuated by the movement of the toilet seat and cover from a vertical open position toward a horizontal closed position.

A more specific object of the invention is to provide an arrangement of the type described wherein a line connected to an internal flush valve is automatically connected to a toilet seat cover, when the cover is moved to a vertical open position, so that when the cover and seat are moved toward a horizontal closed position, tension on the line will lift the flush valve causing the toilet to be flushed.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
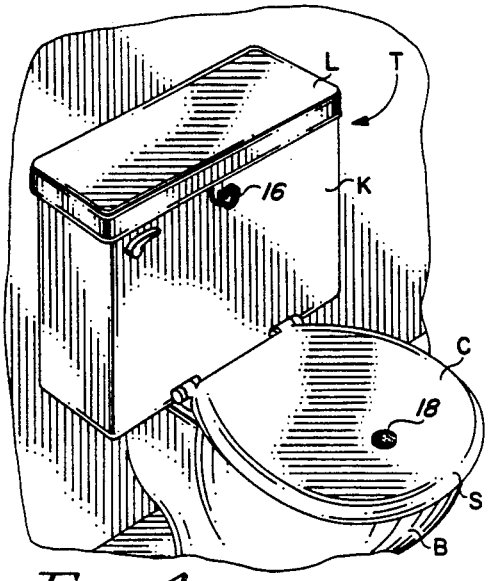
FIG. 1 is an isometric view of a toilet having a flushing mechanism actuating device embodying features of the invention.

Referring now to the drawings for a better understanding of the invention, in FIG. 1 there is illustrated a conventional toilet, indicated generally at T, comprising a bowl B with a hinged seat S and cover C, and a water cabinet or tank K with a lid L and an internal flush mechanism that includes a flush valve V. As the portion of the flushing mechanism relating to the filling of the tank with water may be conventional, it is not illustrated.

Figure 2:
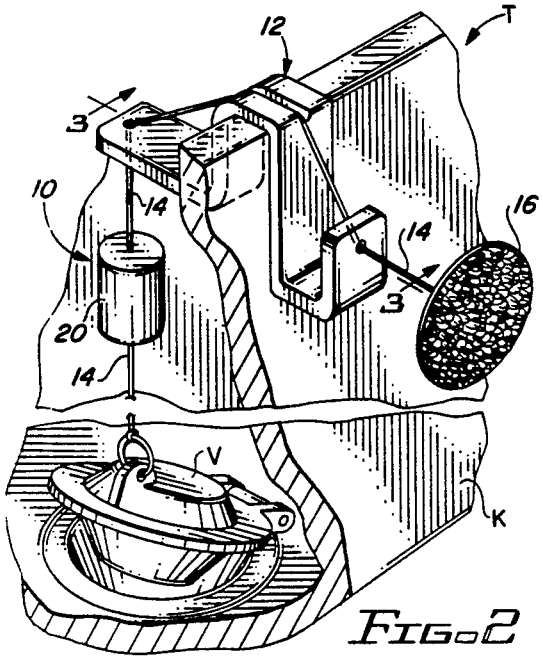
FIG. 2 is an enlarged view of the structure illustrated in FIG. 1, with portions of the structure broken away.

As best seen in FIG. 2, the toilet flushing mechanism is actuated by a device, indicated generally at 10, that embodies features of the invention. The device 10 includes a line guide bracket 12, formed of metal or plastic, that is adapted to be mounted on the toilet tank K under the Lid L.

Bracket 12 includes first, second, third, fourth, fifth, and sixth sections 12*a*, 12*b*, 12*c*, 12*d*, 12*e*, and 12*f*, respectively that are angularly related to each other and arranged to clamp over the upper edge of the tank, with inner and outer portions located within and without the tank, respectively.

Figure 3:
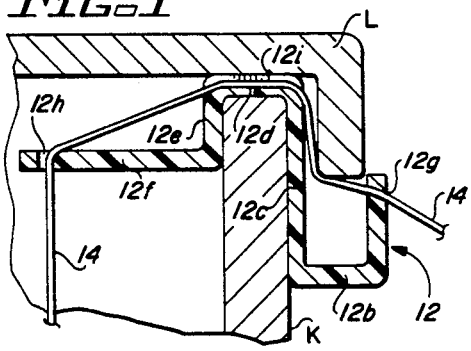
FIG. 3 is a fragmentary vertical sectional view taken on line 3—3 of FIG. 2.

As best seen in FIG. 3, the central portion of the bracket 12, comprising sections 12*c*, 12*d*, and 12*e*, is generally U-shaped and adapted to be fitted over an upper edge of the front wall of tank K.

Extending forwardly from the lower end of section 12*c* is the horizontal section 12*b* which has the vertical section 12*a* extending upwardly from the front edge thereof to the lower edge of tank lid L. Sections 12*a* and 12*b* comprise the outer portions of bracket 12.

An inner portion comprises section 12*f*, which extends rearwardly from the lower end of section 12*e*.

Sections 12*a* and 12*f* have holes 12*g* and 12*h*, respectively, extending therethrough, and section 12*d* has a groove 12*i* in the upper surface thereof. The purpose of holes 12*g* and 12*h* and groove 12*i* is to guide a line 14, as hereinafter described.

A line 14 in the form of a nylon cord or similar flexible material has its outer end attached to a relatively small piece 16 of detachable self-fastening material of the type that will adhere or cohere to a piece of like material upon pressure contact.

Figure 6:
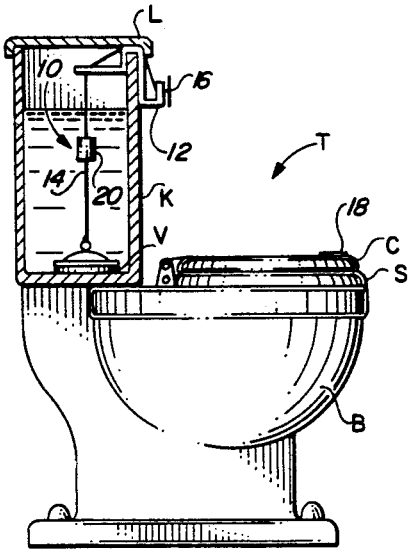
FIGS. 5 and 6 are views similar to that of FIG. 4, but showing the cover being moved toward a horizontal closed position and in the closed position, respectively.
Figure 5:
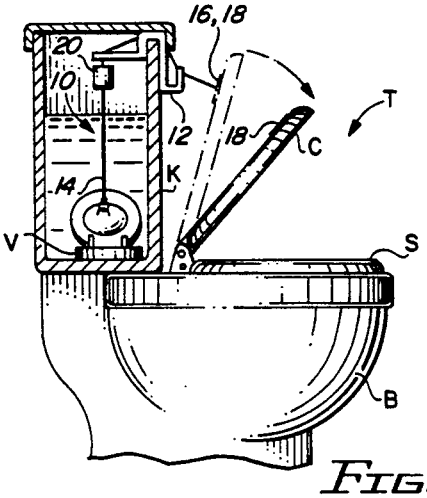

In the preferred embodiment of the invention, the detachable self-fastening material employed is Velcro, as shown as elements 16 and 18 in FIG. 1; however, it would be possible to use another material coated with a pressure sensitive adhesive, as shown as elements 16' and 18' in FIG. 6, or a magnetic material, as shown as elements 16" and 18" in FIG. 5, or substance, so long as the two pieces will temporarily self-attach to each other upon the application of pressure thereagainst and will detach from each other when a certain amount of pressure is used to pull them apart.

When the flush valve is closed the material piece 16 is positioned against the outer forwardly facing surface of bracket first section 12*a* immediately below the toilet tank lid L.

Figure 4:
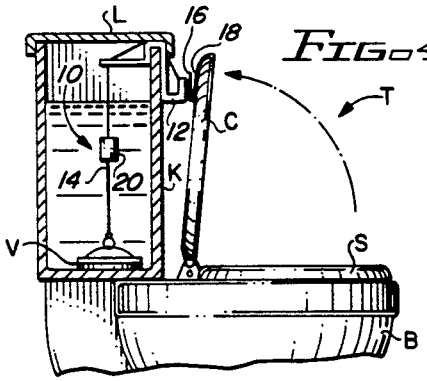
FIG. 4 is a fragmentary side elevational view, with portions of the structure shown in vertical section, illustrating the toilet seat cover in a vertical open position.

A second piece 18 of like detachable self-fastening material is permanently secured to the upper surface of toilet seat cover C in such a location that when the cover is raised to the vertical open position illustrated in FIG. 4, the two pieces of material will contact and be temporarily attached to each other.

As best seen in FIG. 3 and 6, line 14 is threaded through hole 12*g* in section 12*a*, over the top of section 12*d* in groove 12*i*, and through hole 12*h* in section 12*f*. The inner end of line 14 is connected to a flush valve V at the bottom of the tank K.

A weight 20 is attached to line 14 at a location between the flush valve and bracket sixth section 12*f*. The primary purpose of the weight is to return the first piece of detachable self-fastening material to its original position against the outer surface of bracket section 12*a* after the toilet has been flushed, as hereinafter described.

Now to describe the operation of the device. As best seen in FIG. 4, when the toilet seat cover C is in the vertical open position, first and second pieces of detachable self-fastening material 16 and 18, respectively, are in contact with and attached to each other.

When it is desired to flush the toilet, the seat cover C is moved downwardly from the vertical open position of FIG. 4 toward the horizontal closed position of FIG. 6. As this occurs the flush valve is lifted to flush the toilet.

As the seat cover is moved further downwardly, as shown in FIG. 5, the weight 20 moves upwardly until it contacts the underside of bracket section 12*f* to limit further movement of the line. When further movement of the line is so limited, as the cover and seat are moved to the closed position of FIG. 6, the two pieces of detachable self-fastening material are pulled apart, and the weight places tension on the line to return the first piece of detachable self-fastening material to its original position against the outer surface of bracket first section 12*a*. At the same time the flush valve is returned to its closed position.

Thus, it will be appreciated that the invention comprises a comparatively simple mechanism that is relatively inexpensive to manufacture, and which can be easily and quickly installed for use on most conventional toilets.

What is claimed is:

1. A toilet flushing arrangement including a device for use with a toilet having a bowl, with a hinged seat and cover, and a water tank, with a lid and an internal flushing mechanism including a flush valve movable between open and closed positions, said device being operable to actuate the flush valve by the movement of the toilet seat cover from a vertical open position toward a horizontal closed position, said device comprising:

(a) a guide bracket having a medial portion, arranged and disposed to be mounted on an upper end of said toilet tank under said lid and having inner and outer portions adapted to be positioned within and without said tank, respectively;

(b) a thin flexible line extending through said guide bracket with an inner end adapted to be attached to said flush valve and an outer end attached to a first piece of detachable self-fastening material;

(c) a second piece of detachable self-fastening material adapted to be secured to an upper surface of said toilet seat cover and disposed for contact with and attachment to said first piece of detachable self-fastening material when said toilet seat cover is in a vertical open position, whereby when said cover is moved from its open position toward its closed position, tension will be exerted on said line causing said flush valve to be lifted and opened to flush said toilet and whereby when said cover is moved further toward its closed position said pieces of detachable self-attaching material will separate from each other;

(d) a weight secured to said line and operable to maintain tension on said line whereby when said flush valve is in said closed position said first piece of detachable self-fastening material will be positioned against an outer surface of said bracket immediately below said lid, and when said cover has been moved far enough toward said horizontal closed position to cause said pieces of detachable self-fastening material to separate, said weight will cause said first piece of detachable self-attaching material to be repositioned against an outer surface of said bracket.

2. A device according to claim 1, wherein said guide bracket inner and outer portions have holes extending therethrough for receiving said line, and said medial portion has a groove in an upper surface thereof for receiving said line.

3. A device according to claim 1, wherein weight is secured to said lines at a location close enough to said bracket whereby, when said cover is moved to a predetermined position, said weight will contact said bracket to prevent further movement of said line and thereby cause said pieces of detachable self-fastening material to separate.

4. A device according to claim 1, wherein said detachable self-fastening material is a synthetic material which adheres when pressed together.

5. A device according to claim 1, wherein said detachable self-fastening material is magnetic.

6. A device according to claim 1, wherein said detachable self-fastening material is coated with pressure sensitive adhesive.

7. A toilet flushing arrangement including a device for use with a toilet having a bowl, with a hinged seat and cover, and a water tank, with a lid and an internal flushing mechanism including a flush valve movable between a vertical open and a horizontal closed position, said device being operable to actuate the flush valve by the movement of the toilet seat cover from an open position toward a closed position, said device comprising:

(a) a guide bracket, arranged and disposed to be mounted on an upper end of said toilet tank under said lid;

(b) a thin flexible line extending through said guide bracket with an inner end adapted to be attached to said flush valve and an outer end attached to a first piece of detachable self-fastening material;

(c) a second piece of detachable self-fastening material adapted to be secured to an upper surface of said toilet seat cover and disposed for contact with and attachment to said first piece of detachable self-fastening material when said toilet seat cover is in a vertical open position whereby when said cover is moved from its open position toward its closed position, tension will be exerted on said line causing said flush valve to be lifted and opened to flush said toilet and whereby when said cover is moved further toward its closed position said pieces of detachable self-attaching material will separate from each other;

(d) a weight secured to said line and operable to maintain tension on said line whereby when said flush valve is in said closed position said first piece of detachable self-fastening material will be positioned against an outer surface of said bracket immediately below said lid, and when said cover has been moved far enough toward said horizontal closed position to cause said pieces of detachable self-fastening material to separate, said weight will cause said first piece of detachable self-attaching material to be repositioned against an outer surface of said bracket.

8. A device according to claim 7, wherein said guide bracket has a medial portion, arranged and disposed to be mounted on an upper end of said toilet tank under said lid, and has inner and outer portions adapted to be positioned within and without said tank, respectively.

9. A device according to claim 8, wherein said guide bracket inner and outer portions have holes extending therethrough for receiving said line, and said medial portion has a groove in an upper surface thereof for receiving said line.

10. A device according to claim 7, wherein weight is secured to said lines at a location close enough to said bracket whereby, when said cover is moved to a predetermined position, said weight will contact said bracket to prevent further movement of said line and thereby cause said pieces of detachable self-fastening material to separate.

11. A device according to claim 7, wherein said detachable self-fastening material is a synthetic material which adheres when pressed together.

12. A device according to claim 7, wherein said detachable self-fastening material is magnetic.

13. A device according to claim 7, wherein said detachable self-fastening material is coated with pressure sensitive adhesive.

14. A toilet flushing arrangement including a device for use with a toilet having a bowl, with a hinged seat and cover, and a water tank, with a lid and an internal flushing mechanism including a flush valve movable between a vertical open and a horizontal closed position, said device being operable to actuate the flush valve by the movement of the toilet seat cover from an open position toward a closed position, whereby said toilet cannot be flushed with the seat and cover in an open position, said device comprising:

(a) a thin flexible line having an inner end adapted to be attached to said flush valve and an outer end attached to a first piece of detachable self-fastening material;

(b) means for guiding said line under said lid and into said tank to said flush valve;

(c) a second piece of detachable self-fastening material adapted to be secured to an upper surface of said toilet seat cover and disposed for contact with and attachment to said first piece of detachable self-fastening material when said toilet seat cover is in a vertical open position whereby when said cover is moved from its open position toward its closed position, tension will be exerted on said line causing said flush valve to be lifted and opened to flush said toilet and whereby when said cover is moved further toward its closed position said pieces of detachable self-attaching material will separate from each other;

(d) a weight secured to said line and operable to maintain tension on said line, whereby when said flush valve is in said closed position said first piece of detachable self-fastening material will be positioned adjacent an outer surface of said tank immediately below said lid, and when said cover has been moved far enough toward said horizontal closed position to cause said pieces of detachable self-fastening material to separate, said weight will cause said first piece of detachable self-attaching material to be repositioned adjacent said tank outer surface.

15. A device according to claim 14, wherein said guide means comprises a guide bracket arranged and disposed to be mounted on an upper end of said toilet tank under said lid.

16. A device according to claim 15 wherein said guide bracket has a medial portion, arranged and disposed to be mounted on an upper end of said toilet tank under said lid, and has inner and outer portions adapted to be positioned within and without said tank, respectively.

17. A device according to claim 15, wherein weight is secured to said lines at a location close enough to said bracket whereby, when said cover is moved to a predetermined position, said weight will contact said bracket to prevent further movement of said line and thereby cause said pieces of detachable self-fastening material to separate.

18. A device according to claim 14, wherein said detachable self-fastening material is a synthetic material which adheres when pressed together.

19. A device according to claim 14, wherein said detachable self-fastening material is magnetic.

20. A device according to claim 14, wherein said detachable self-fastening material is coated with pressure sensitive adhesive.

* * * * *